US009439480B1

(12) United States Patent
French

(10) Patent No.: US 9,439,480 B1
(45) Date of Patent: Sep. 13, 2016

(54) WRISTBAND WITH MEDALLION

(71) Applicant: Clinton D. French, Clive, IA (US)

(72) Inventor: Clinton D. French, Clive, IA (US)

(73) Assignee: Wootworks, LLC, Clive, IA (US)

( * ) Notice: Subject to any disclaimer, the term of this patent is extended or adjusted under 35 U.S.C. 154(b) by 32 days.

(21) Appl. No.: 14/625,681

(22) Filed: Feb. 19, 2015

Related U.S. Application Data

(60) Provisional application No. 61/942,928, filed on Feb. 21, 2014.

(51) Int. Cl.

| | |
|---|---|
| ***A44C 5/00*** | (2006.01) |
| ***G09F 7/18*** | (2006.01) |
| *G09F 3/00* | (2006.01) |

(52) U.S. Cl.
CPC ..... *A44C 5/0015* (2013.01); *A44C 5/0053* (2013.01); *G09F 7/18* (2013.01); *G09F 3/005* (2013.01)

(58) Field of Classification Search
CPC ..... G09F 3/005
USPC ..... 40/633
See application file for complete search history.

(56) References Cited

U.S. PATENT DOCUMENTS

| | | | | |
|---|---|---|---|---|
| 1,553,198 | A * | 9/1925 | Stern | 63/31 |
| 5,219,069 | A * | 6/1993 | Sonnek | 206/0.83 |
| 5,588,310 | A * | 12/1996 | Lai | 63/15 |
| 6,412,304 | B1 * | 7/2002 | Adelman | A44C 17/005 63/26 |
| 6,532,766 | B1 * | 3/2003 | Chia et al. | 63/26 |
| 2005/0005637 | A1 * | 1/2005 | Rapport | 63/1.14 |
| 2005/0252240 | A1 * | 11/2005 | Junod | 63/10 |
| 2013/0055760 | A1 * | 3/2013 | Rush et al. | 63/1.14 |
| 2014/0090418 | A1 * | 4/2014 | Mihalyo | 63/3 |

* cited by examiner

*Primary Examiner* — Kristina Junge
(74) *Attorney, Agent, or Firm* — McKee, Voorhees & Sease, PLC

(57) ABSTRACT

A resilient wristband is provided with at least one cavity in which a medallion is removably mounted. The medallion has opposite faces, each having different designs or indicia. The medallion can be rotated in the cavity to selectively display one or the other of the faces.

17 Claims, 4 Drawing Sheets

WRISTBAND WITH MEDALLION

CROSS-REFERENCE TO RELATED APPLICATIONS

This application claims priority under 35 U.S.C. §119 to provisional application Ser. No. 61/942,928 filed Feb. 21, 2014, herein incorporated by reference in its entirety.

FIELD OF THE INVENTION

The invention is directed towards a wrist band having a medallion with opposing faces and different indicia on each face so that a person wearing the wristband can selectively choose which face of the medallion is visible.

BACKGROUND OF THE INVENTION

Wristbands of various types are well-known and popular. For example, silicone gel wristbands or bracelets are flexible, fit any size wrist, can be made in a variety of colors, and can be imprinted with words or logos. These silicone wristbands are relatively inexpensive to manufacture. These wristbands or bracelets are static, in that the user or wearer has to change wristbands to change the appearance. Thus, some people own multiple wrist bands of different colors or having different indicia or messages, so that they can interchange wristbands as desired. The more wristbands a person owns, the more space is required for storage of the wristbands.

Therefore, it is desirable to have a dynamic wristband which can be modified to change its appearance as selected by the person wearing the wristband.

Accordingly, a primary objective of the present invention is the provision of a wristband which holds interchangeable medallions to change the appearance of the wristband.

Another objective of the present invention is the provision of a wristband having a reversible medallion.

Another objective of the present invention is the provision of a wristband having one or more cavities for holding one or more medallions.

A further objective of the present invention is the provision of a wristband having medallions located on the front and back of the wrist.

Yet another objective of the present invention is the provision of a single wristband with multiple interchangeable medallions each having different faces.

Still another objective of the present invention is the provision of a wristband having a reversible medallion which can be flipped to front and back faces without removing the medallion from the wristband.

A further objective of the present invention is the provision of a wristband having a recess to interchangeably receive different medallions.

Still another objective of the present invention is the provision of a wristband with medallions which is economical to manufacture and durable in use.

DETAILED DESCRIPTION OF THE PREFERRED EMBODIMENTS

Figure 1:
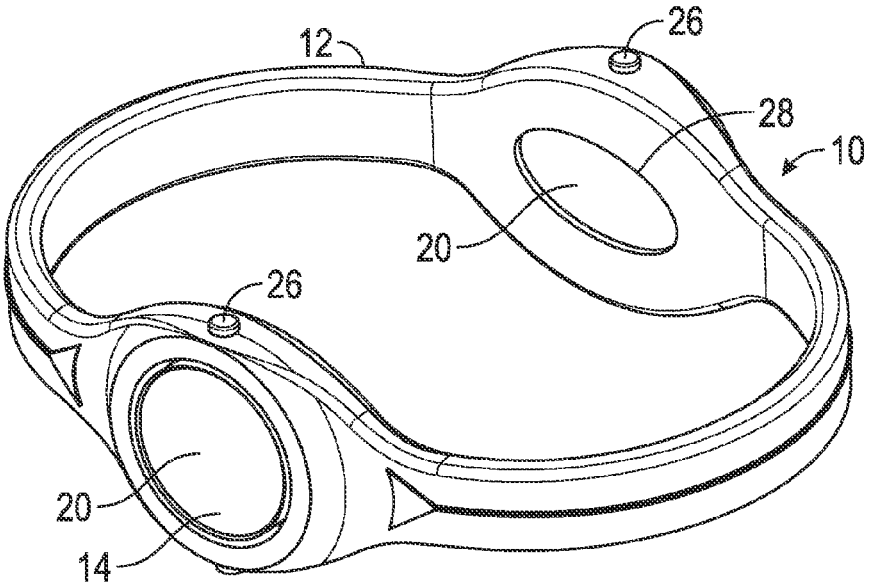
FIGS. 1, 2, 3 and 4 are respective views of the wristband and medallions of the present invention illustrating the sequence of steps for rotating one of the medallions from the first side shown in FIG. 1 to the second side shown in FIG. 4.
Figure 2:
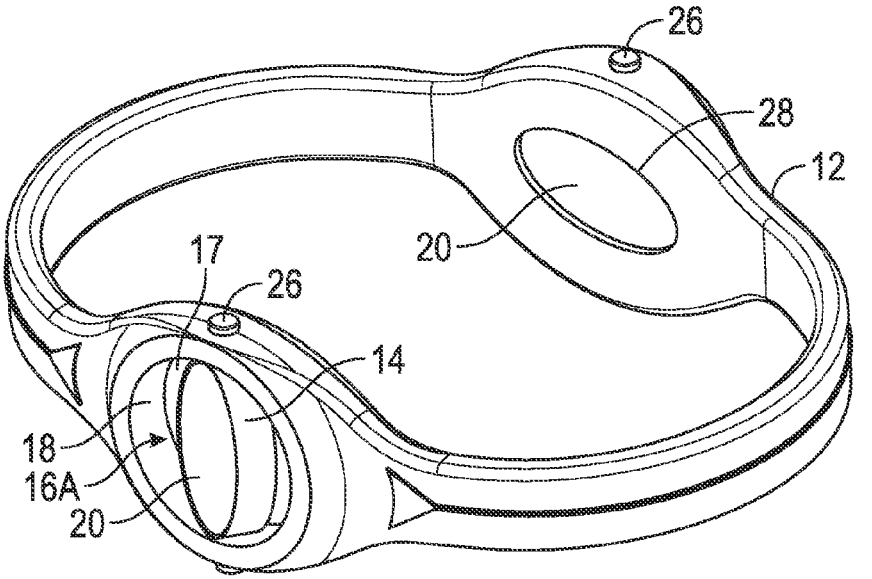
Figure 3:
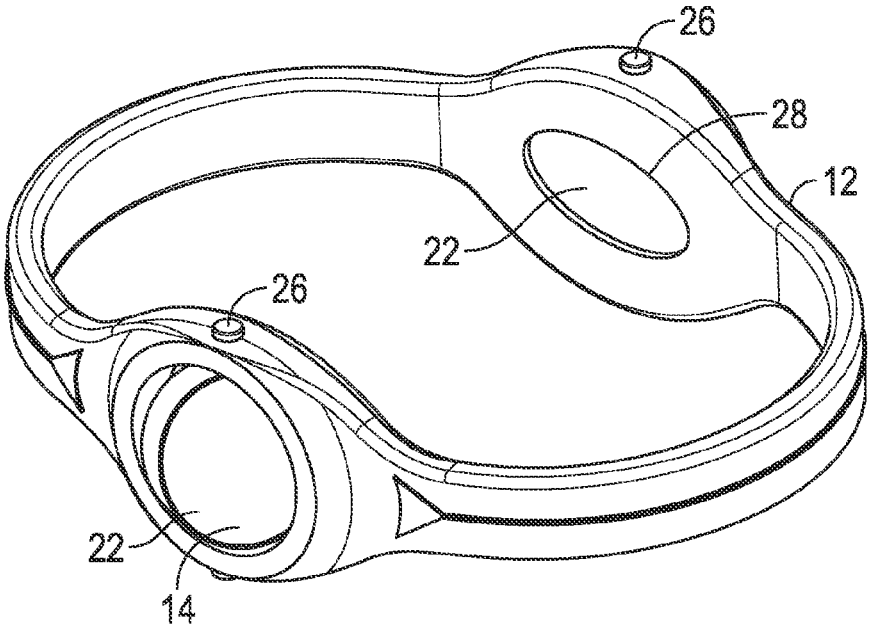

The wristband of the present invention is generally designated by the reference numeral 10 in the drawings. The wristband 10 includes a strap 12 and one or more medallions or coins 14. The strap 12 is preferably a onepiece molded strap made of a lightweight, yet strong, flexible, stretchable material, such as silicone.

As shown in the drawings, in a preferred embodiment, the strap 12 includes front and back cavities 16A, 16B, corresponding to the front and back of a person's wrist. The cavities or recesses 16A, 16B each have a back wall 17, a sidewall 18, and a pair of opposing holes 19 formed in the sidewall 18.

Figure 4:
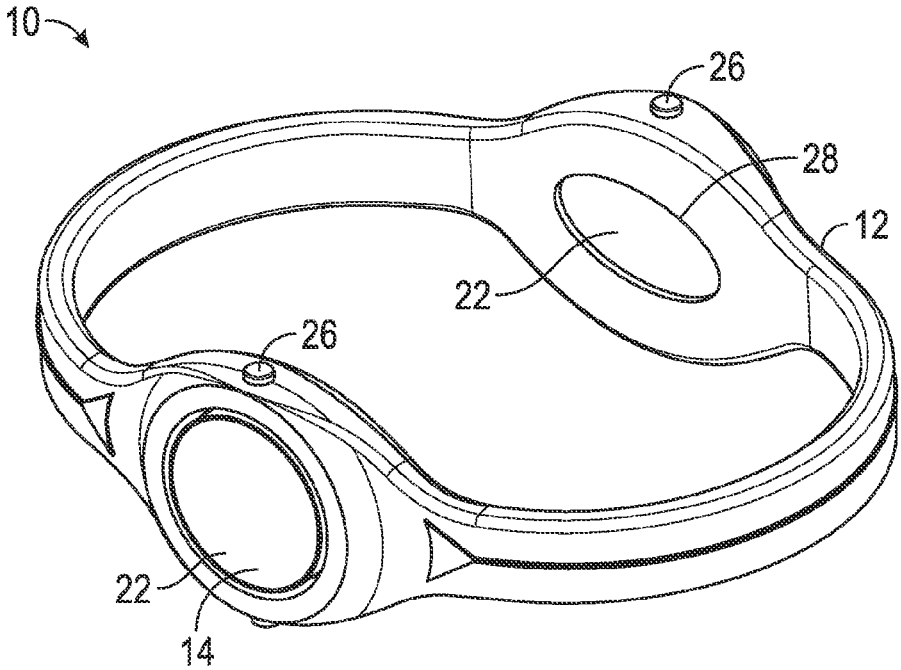
Figure 5:
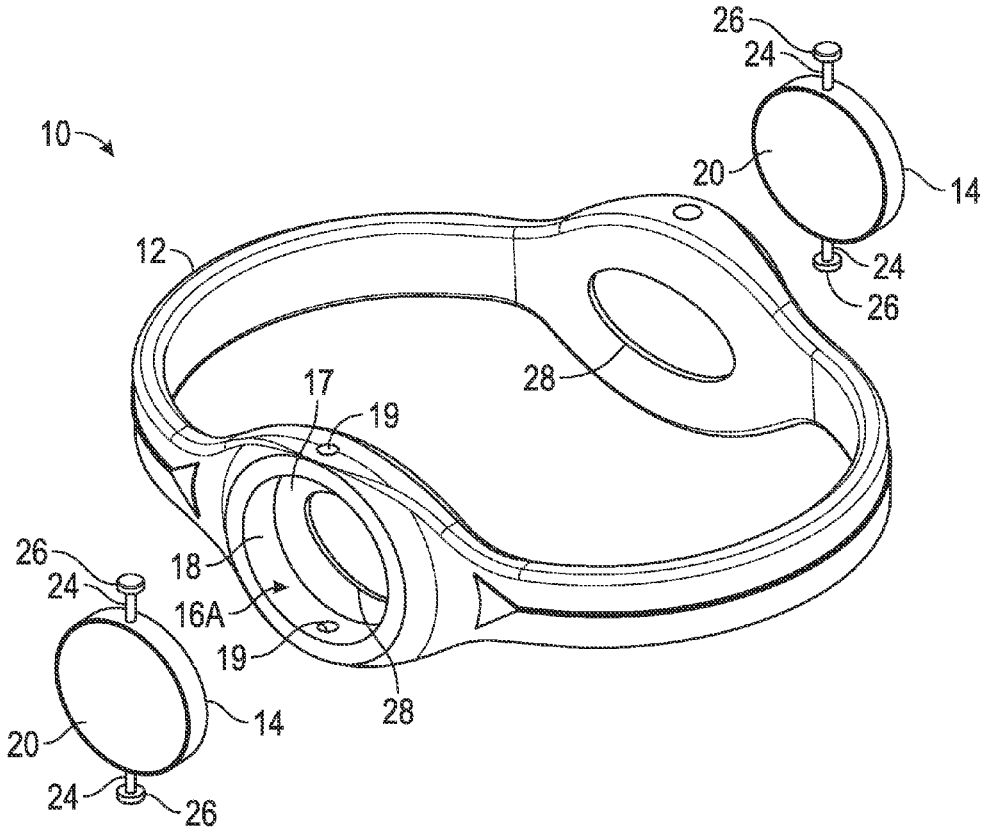
FIG. 5 is an exploded perspective view of the wristband and medallions according to the present invention.
Figure 6:
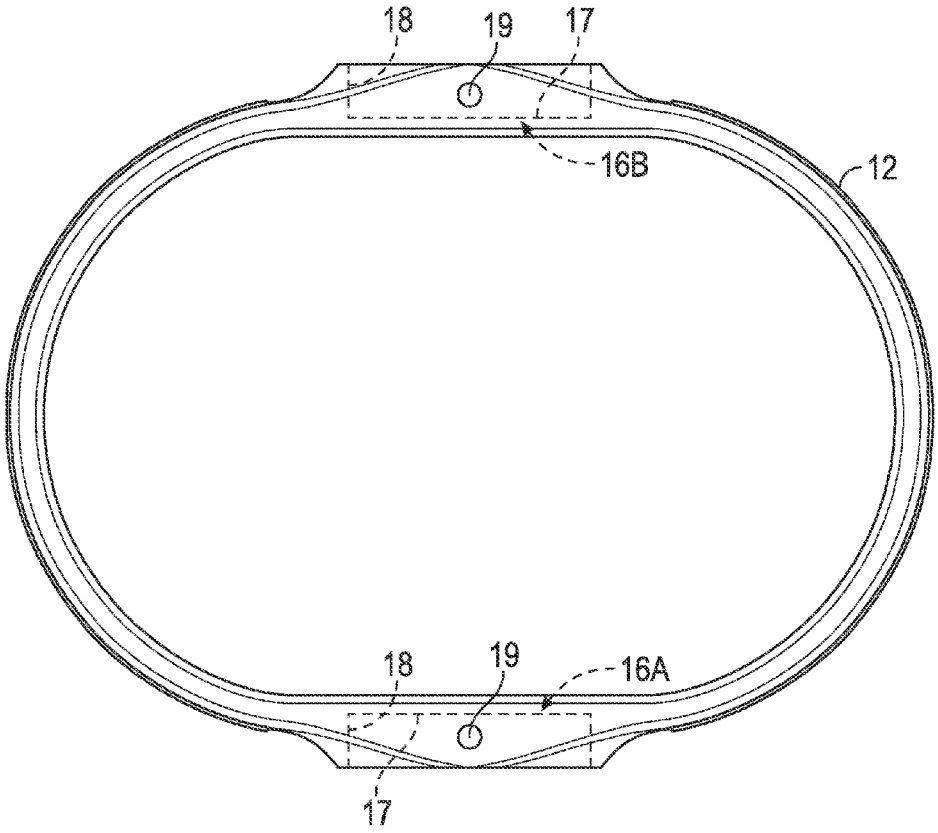
FIG. 6 is a side elevation view of the wristband, without the medallion.
Figure 7:
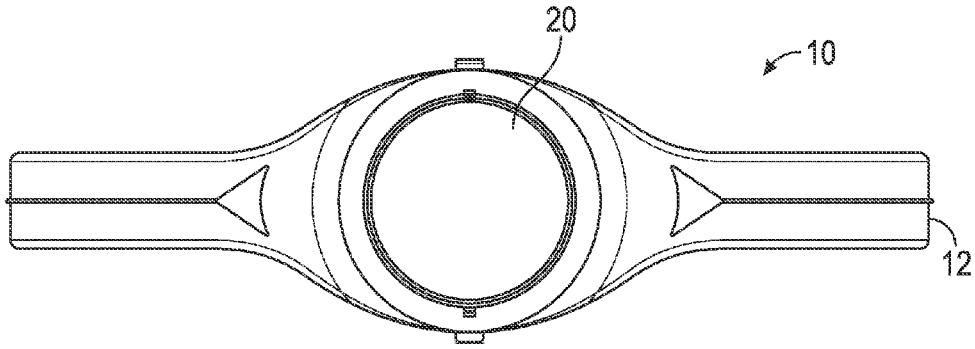
FIG. 7 is a top plan view of the wristband showing one of the medallion cavities.

Each medallion 14 has opposite sides or faces 20, 22, with different printing designs, or indicia on each face. Thus, if the wristband 10 has two medallions 14, the wearer has four options on the four faces. A pair of pins 24 extend outwardly from opposite edges of the medallion 14 and each pin has an enlarged head 26. The medallion 14 is adapted to be selectively and removably mounted in one of the cavities or recesses 16A, 16B by pushing the heads 26 through the holes 19 so that the medallion 14 resides within the cavity. Thus, the top or visible surface of the medallion 14 is substantially flush with the top surface of the strap 12, as shown in FIGS. 1 and 4.

The medallion 14 can be flipped or rotated 180 degrees about the axis defined by the pins 24 so that the first side or face 20 or second side or face 22 of the medallion 14 is displayed. FIGS. 1-4 show rotation of the medallion 14 from the first side 20 to the second side 22. It is understood that the medallion 14 can be rotated in either direction to change the visible side 22 or 24 of the medallion. This flipping of the medallion 14 can be done without removing the medallion 14 from the strap 12. Also, the medallion 14 can be exchanged with other medallions having different indicia on the opposite faces 20, 22.

As another alternative, the pin heads 26 can be eliminated, and the pins 24 extend partially into the sidewall 17 without extending through the sidewall 17, such that the ends of the pins 24 are covered by the sidewall.

While the drawings show the strap 12 as having dual cavities 16 and medallions 14 spaced approximately 180 degrees from one another, it is understood that the strap 12 can be formed with a single cavity for a single medallion, which could be worn on either the front or back of the wrist.

In a preferred embodiment, the back wall 17 of the recesses 16A, B is provided with an elongated slot 28. When the medallion 14 is turned, the slot 28 allows the back wall 17 to stretch or deform. To minimize stress on the sidewall 18 adjacent the holes 19. Thus, the slot 28 reduces the risk of the sidewall 18 tearing when the medallion 14 is flipped from one face to the opposite face. Alternatively, the slot 28 can be formed as a straight line cut or an x-shaped cut in the back wall 17, or the slot 28 can be eliminated from the back wall 17. Another alternative is to substantially eliminate the back wall 17 from wristband 10, such that the cavities 16A, B are holes extending through the wristband material. This through-hole alternative results in the back or hidden face of the medallion 14 contacting the wearer's skin.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A wristband, comprising:

a strap to extend around a person's wrist;

a first cavity in the strap;

a first medallion removably mounted to the strap so as to reside in the cavity;

the first cavity having a perimeter sidewall, and the first medallion having opposing pins extending through holes in the sidewall to mount the medallion on the strap;

the first medallion having opposite faces, and can be flipped between the opposite faces by rotation about the pins while mounted to the strap;

the cavity including a stretchable back wall with a hole therein to allow deformation of the back wall and thereby minimize stress on the cavity sidewall during flipping of the medallion;

wherein the opposing pins each have an enlarged head residing outside the perimeter sidewall to retain the medallion in the first cavity;

wherein the enlarged heads are insertable through the holes in the perimeter sidewall from an interior of the cavity to outside the perimeter wall.

2. The wristband of claim 1 wherein the hole is elongated.

3. The wristband of claim 1 further comprising a second cavity on the strap spaced from the first recess and a second medallion removably mounted to the strap so as to reside in the second cavity.

4. The wristband of claim 1 wherein the strap is a stretchable material.

5. The wristband of claim 1 wherein the strap is silicone.

6. The wristband of claim 1 wherein the medallion has opposite sides with different printing on the opposite sides.

7. The wristband of claim 1 wherein the strap is one piece and extends continuously 360°.

8. A band for wearing by a person, comprising:

an elastic strap having a first recess with a back wall, an upstanding perimeter wall, and two opposed through holes to an outside surface of the perimeter wall;

a first medallion sized to fit into the recess and having opposite front and back faces;

the first medallion being reversibly mounted in the recess without removing the first medallion from the recess and with either the front or back face being visible;

wherein the first medallion comprises opposing pins, said pins configured to removably attach the first medallion to the elastic strap;

wherein the opposing pins have an enlarged head residing outside the upstanding perimeter wall to retain the medallion in the first cavity;

wherein the enlarged heads are insertable through the holes in the perimeter wall from an interior of the recess to the outside of the upstanding perimeter sidewall; and wherein the first medallion is rotatably attached to the elastic strap, and the first medallion is rotatable within the strap via elastically deforming the first recess and the upstanding wall.

9. The band of claim 8 wherein the perimeter wall has opposing holes and wherein the medallion has opposite pins extending radially outwardly for receipt in the holes.

10. The band of claim 9 wherein the medallion is rotatable about the pins to reverse the visible face without removing the medallion from the recess.

11. The band of claim 10 wherein the back wall includes a discontinuous area to allow deformation of the back wall when the medallion is rotated.

12. The band of claim 11 wherein the strap has a longitudinal axis and the discontinuous area is an elongated slot having a major axis extending parallel to the strap longitudinal axis.

13. The band of claim 8 further comprising a second recess on the strap spaced 180° from the first recess, and a second medallion with opposite front and back faces reversibly mounted in the second recess.

14. The band of claim 8 wherein the strap is silicone.

15. The band of claim 8 wherein the strap has a one-piece construction extending continuously 360°.

16. The band of claim 8 wherein the strap is resilient.

17. The band of claim 8 wherein the front and back faces have different indicia thereon.

* * * * *